United States Patent [19]

Cottenceau et al.

[11] Patent Number: 4,691,535

[45] Date of Patent: Sep. 8, 1987

[54] METHOD OF AND APPARATUS FOR JOINING A SELECTED YARN TO A YARN BEING KNITTED

[75] Inventors: Remi Cottenceau, Viry, France; Francois Fischer, Carouge; Simon Arieh, Geneva, both of Switzerland

[73] Assignees: Mayer & Cie. GmbH & Co.; Sipra Patententwicklungs - und Beteiligungsgesellschaft mbH, both of Albstadt, Fed. Rep. of Germany

[21] Appl. No.: 799,552

[22] Filed: Nov. 19, 1985

Related U.S. Application Data

[63] Continuation of Ser. No. 445,987, Dec. 1, 1982, abandoned.

[30] Foreign Application Priority Data

Dec. 3, 1981 [CH] Switzerland ..... 7727/81

[51] Int. Cl.[4] ..... D04B 15/62

[52] U.S. Cl. ..... 66/144; 289/3

[58] Field of Search ..... 66/144; 289/2, 3

[56] References Cited

U.S. PATENT DOCUMENTS

| | | | |
|---|---|---|---|
| 29,063 | 7/1860 | Courser | 289/3 |
| 707,826 | 8/1902 | Colman | 289/3 |
| 2,232,616 | 2/1941 | Larkin | 66/144 |
| 2,349,953 | 5/1944 | Fürst | 289/3 |
| 2,879,095 | 3/1959 | Actenweger | 289/2 X |
| 3,892,432 | 7/1975 | Ingus | 289/2 X |

*Primary Examiner*—Wm. Carter Reynolds

*Attorney, Agent, or Firm*—Karl F. Ross; Herbert Dubno

[57] ABSTRACT

A yarn-selecting device of a knitting frame comprises a mechanism for joining the yarn being knitted to a selected yarn to be knitted, which mechanism comprises a swivelling finger for forming a closed loop of the yarn to be knitted. Two levers form an open loop of the yarn being knitted and insert it through the closed loop of the yarn to be knitted on the finger. A hooking lever is provided for pulling the yarn to be knitted through the open loop of the yarn being knitted, after which the open loop-forming lever is retracted thus removing the closed loop from the finger, and the yarn being knitted is cut by a knife while the end of the yarn to be knitted is released from a gripper.

4 Claims, 13 Drawing Figures

FIG. 1
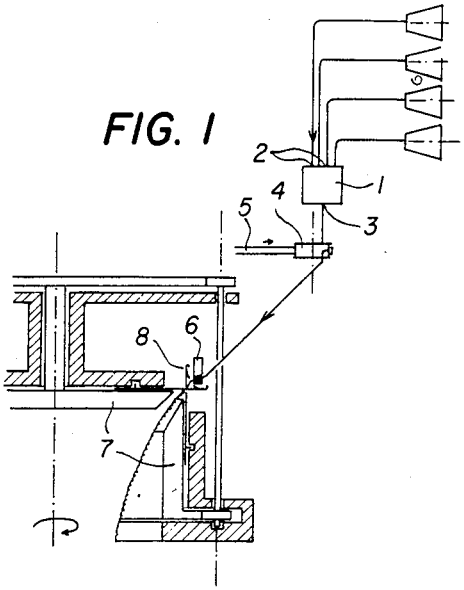
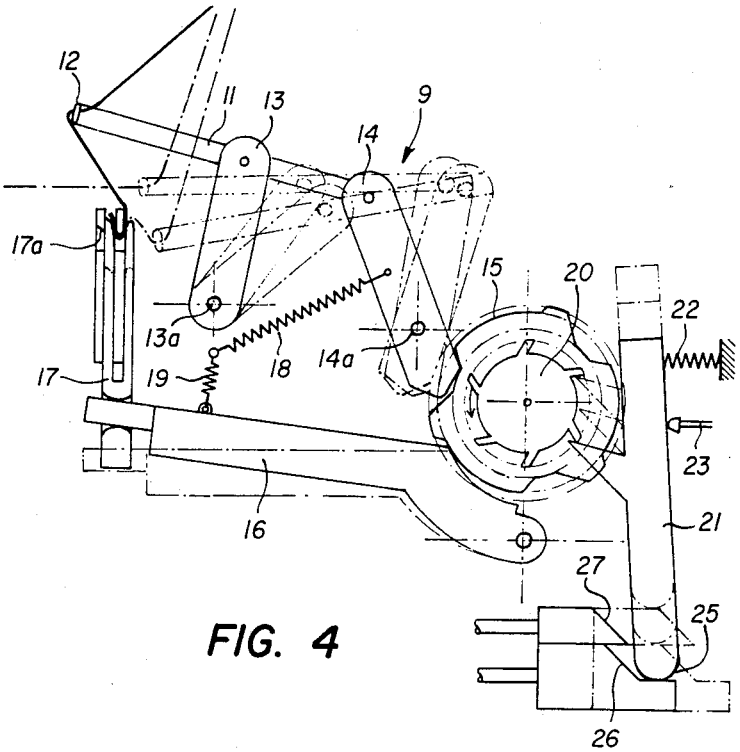
FIG. 4

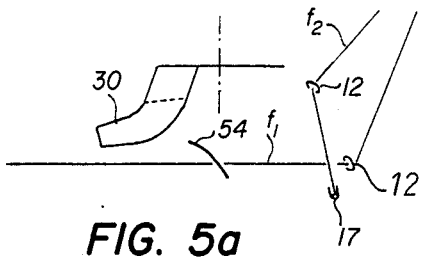
FIG. 5a
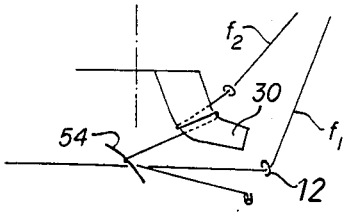
FIG. 5b
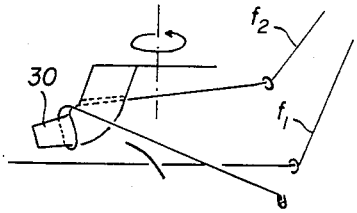
FIG. 5c
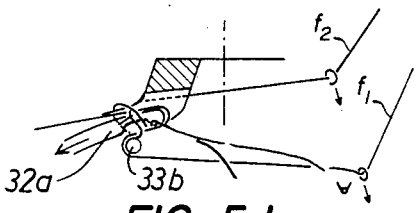
FIG. 5d
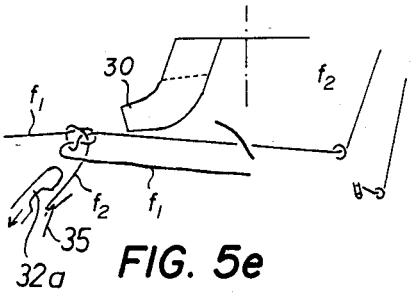
FIG. 5e
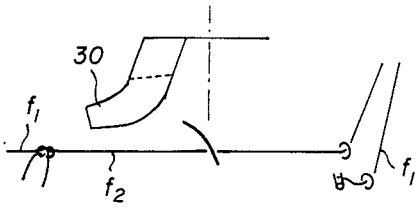
FIG. 5f
FIG. 6
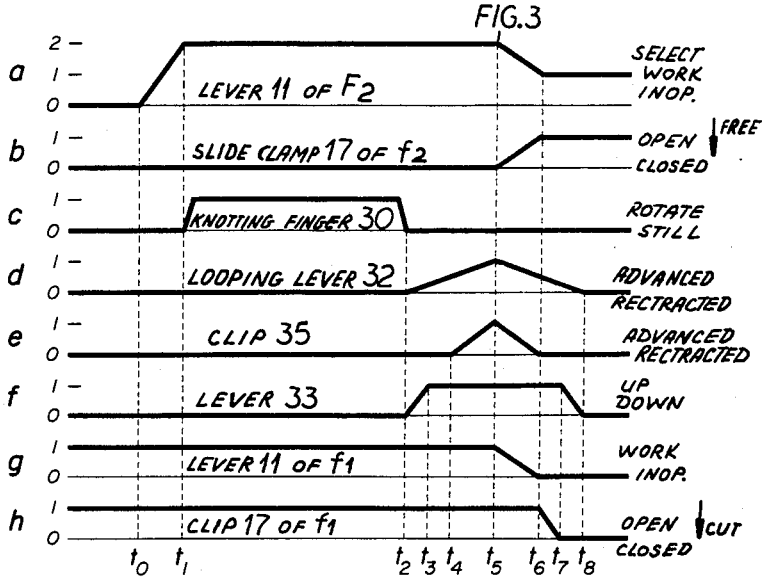

METHOD OF AND APPARATUS FOR JOINING A SELECTED YARN TO A YARN BEING KNITTED

This is a continuation of co-pending application Ser. No. 445,987 filed on Dec. 1, 1982, now abandoned.

FIELD OF THE INVENTION

The present invention relates to a method for joining a yarn selected for knitting, to a yarn being knitted, and to a circular or rectilinear knitting frame comprising a yarn selecting device having at least two inlets, each of which receives a preselected yarn, and an outlet for the selected yarn.

BACKGROUND OF THE INVENTION

Circular frames of this type, in which yarns are selected at the yarn guides, are known. The space occupied by these yarn selecting devices at the bed limits the number of knitting systems and renders maintenance and regulating operations more difficult. Furthermore, as all the preselected yarns enter the selecting device, these yarns can only be conveyed upstream of the yarn guide by means of a disconnectable drive member associated with each of these yarns.

The problem is just as complex for rectilinear frames, as each preselected yarn must be associated with a respective yarn guide, all the yarn guides being stored at the ends of the bed and only the yarn guides of the knitted yarns being associated with the respective knitting systems. According to the number of knitting systems and the number of colors, and according to whether knitting is carried out in single or double panels, the number of yarn guides may be quite high and therefore present serious problems as regards construction and operation. In addition, it is practically impossible to convey these yarns between the selecting device and the yarn guide.

Solutions consisting in joining a yarn being knitted and a yarn selected for knitting have already been proposed.

The German Pat. No. 47290 has proposed the formation of an open loop on the yarn being knitted, then the formation of a yarn reserve before leading this yarn to the needles. When the new yarn is joined the yarn being knitted is stopped at the open loop, a loop is formed about this open loop with the yarn selected for knitting by passing this selected yarn into and then out of this open loop, after which the two loops are tightened to form the knot. During all these steps the knitting frame is supplied with the previously formed yarn reserve. It is therefore only necessary for the reserve to have a yarn length which is sufficient to provide the yarn length corresponding to the duration necessary for joining the two yarns. It is hardly possible to carry out an operation of this type in less than one second. If the yarn is supplied at a speed of 5 m/s, the reserve must store a length which is proportional to the duration necessary to effect a join, which generally presents problems as regards required space, which can only be reduced at the cost of a decrease in the yarn supply speed.

A proposal has been made for partially solving this problem of space by simplifying the knot necessary for joining the two yarns. For this purpose the German Offenlegungsschrift No. 3 015 191 relates to a mechanism in which the yarn to be knitted passes over the circumference of a drum and is moved along by a belt bearing against a portion of this drum. Positioning fingers serve to place the yarn being knitted and the yarn selected for knitting in the path of a groove which is rigid with the edge of the drum and adapted to release the yarn being knitted from the circumference of the drum and engage thereon the yarn selected for knitting. During this rotation of the drum, the ends of the two yarns retained inside the drum are knotted by a knotter of the conventional type, whereupon this knot is separated from these ends, so that the yarn selected for knitting is moved towards the knitting frame after the yarn being knitted.

In spite of the simplicity of the mechanism which uses a simple knotter, the diameter of the drum is determined by the yarn supply speed and by the duration necessary for the yarn changing operation, and the knotting operation, which generally lasts from 0.1 to 0.2 s, takes place over an angle of approximately 90°, so that the minimum duration of rotation of the drum is from 0.4 to 0.8 s. If a yarn is supplied at 4 m/s, a drum having a circumference of at least 1.6 m, i.e. a diameter of at least 50 cm, will be necessary. A diameter of this size is hardly acceptable in practice, so the supply speed of the knitting frame has to be greatly reduced.

OBJECT OF THE INVENTION

The object of the present invention is to remedy at least some of the above-mentioned disadvantages.

SUMMARY OF THE INVENTION

For this purpose, a first aspect of the invention provides a method of joining a yarn selected for knitting and a yarn being knitted wherein the end of the yarn selected for knitting is held and a closed loop is formed in the vicinity of this end, the path of the yarn being knitted is deflected so as to give it the form of an open loop which is introduced into this closed loop, while letting the yarn pass along this deflected path, the said end of the yarn selected for knitting is passed through this open loop, the closed loop is tightened by pulling the said end in the direction of movement of the yarn being knitted, and the yarn being knitted is simultaneously cut behind the knot which has been thus formed.

The invention also relates to a knitting frame for carrying out the method, comprising a yarn selecting device for each knitting system, which device has at least two inlets, each of which receives a preselected yarn, an outlet for the yarn selected by this device and a yarn guide for bringing this selected yarn to the knitting needles, which yarn guide is associated with a mechanism for joining the yarn being knitted and the yarn selected for knitting. This knitting frame is characterized in that this joining mechanism comprises means for forming a closed loop from the yarn selected for knitting, means for forming an open loop from the yarn being knitted and for passing this loop through the said closed loop, means for passing through the open loop the portion of the yarn selected for knitting which is comprised between its end and the closed loop and for releasing the said closed loop from the means which formed it and tightening it by pulling the said end in the direction of the yarn being knitted, and means for cutting the yarn being knitted, behind of the said knot.

The essential advantage of this method and of the knitting frame for carrying out the method lies in the fact that all the operations that finally result in the joining of the two yarns take place around the yarn being knitted, the path of which is inflected to form an open loop, while letting this yarn run through. The precise moment of joining is determined by the tightening of the knot and can be selected such that the knot then falls into the border of the knitting. As the yarn being knitted continues to run during the knot forming operations, the duration of these operations is not important in practice, only the synchronization between tightening the knot and cutting the yarn being knitted playing an important role. This method can therefore be adapted without any particular problem to all frames, whatever the yarn supply speed, since this speed and the duration of the operations for preparing the join are not connected with each other. Taking into account the yarn supply speeds of knitting frames which can reach 5, and even 6 m/s, it is important to make the joining operation independent of this supply speed, at the same time removing the problem of the yarn reserve or, which amounts to the same, of a determined length of the yarn being knitted along which the join may be made. In both cases the yarn supply speed and the duration of the joining operations are closely connected.

In the case of rectilinear frames the same yarn guide is used for the preselected yarns of one knitting system, which results in a simplification of the frame and, in addition, permits the yarn guide of each knitting system to be associated with a yarn drive mechanism.

BRIEF DESCRIPTION OF THE DRAWING

The accompanying drawing shows schematically and by way of example two embodiments and a variant of the knitting frame for carrying out the method which is the subject matter of the present invention:

FIG. 1 is a diagrammatic radial section of a circular knitting frame.

FIG. 4 is an elevation of a detail of FIGS. 2 and 3.

FIGS. 5*a* to 5*f* are diagrams which show the kinematics of the mechanism shown in FIGS. 2 and 3.

FIG. 5*c'* is a view similar to FIGS. 5*a*–5*f* but showing the stage between stages 5*c* and 5*d*.

FIG. 6 is a graph which shows a function diagram of this mechanism.

SPECIFIC DESCRIPTION

Figure 2:
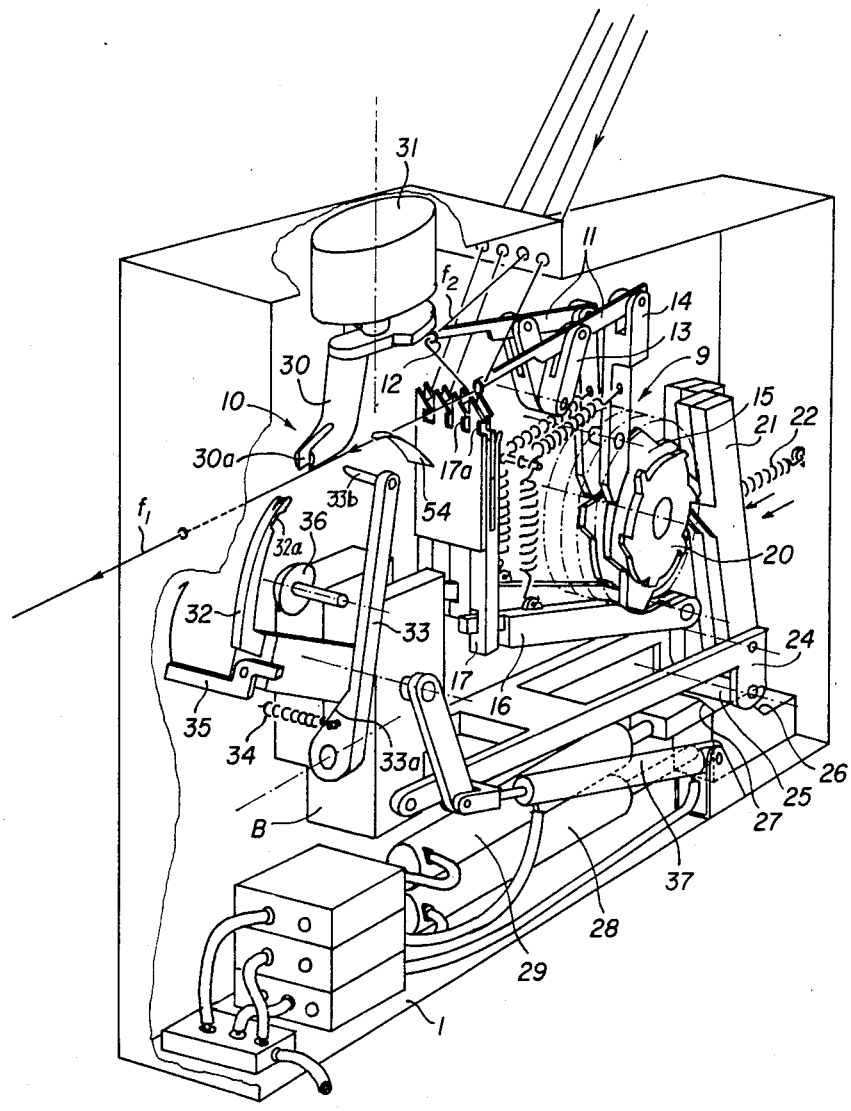
FIG. 2 is an enlarged perspective view of a detail of FIG. 1, illustrating the mechanism for selecting and joining the yarns in a first position.

The radial section of the circular frame shown in FIG. 1 illustrates the yarn selecting station 1, the inlets 2 of which correspond to the number of preselected yarns and the outlet 3 of which delivers to the knitting frame one of these yarns selected by a mechanism which will be described in the following. This selected yarn then passes into a feed mechanism comprising a pulley 4 for each knitting system, all the pulleys 4 being driven by means of an endless belt 5 associated with a motor mechanism (not shown). This selected yarn leads to a yarn guide 6 mounted about the bed 7 carrying the needles 8.

Figure 3:
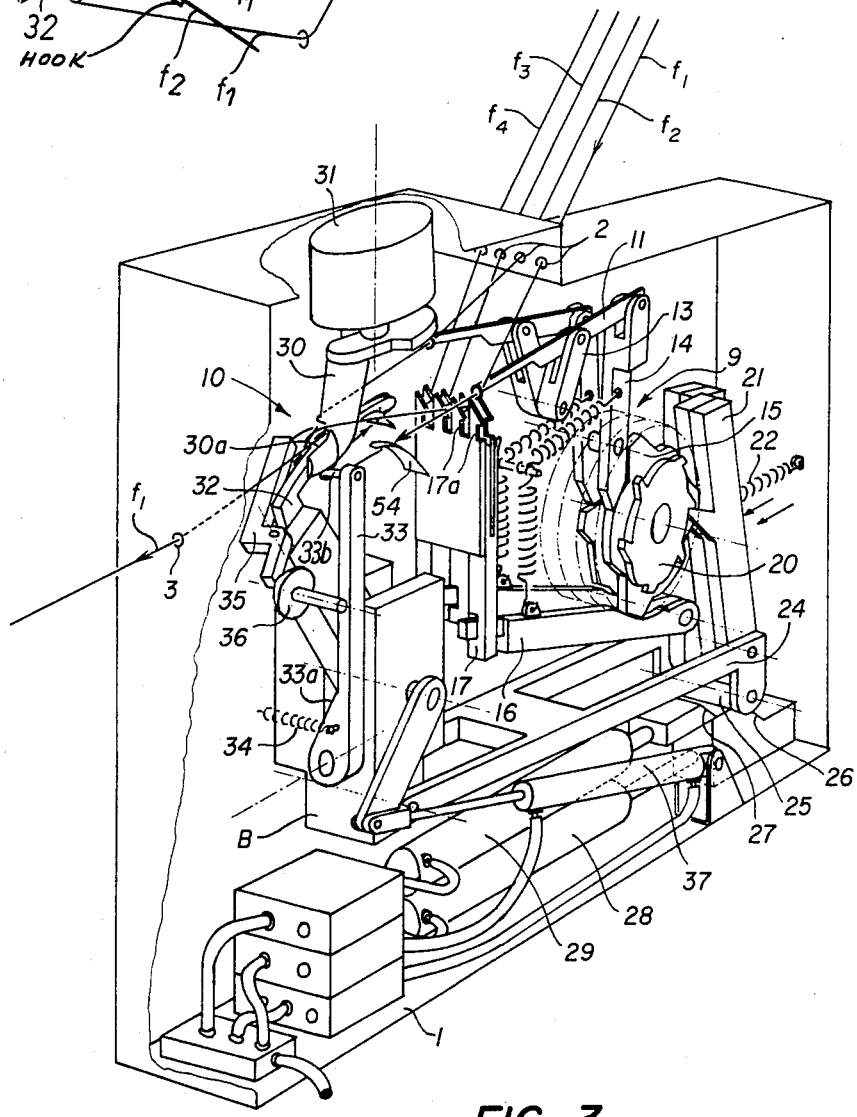
FIG. 3 is a view similar to that of FIG. 2 in a second position.

Referring now to FIGS. 2 to 4, the yarn selecting station 1 comprises a selecting mechanism 9 and a mechanism 10 for joining the yarn $f_1$ being knitted and the yarn $f_2$ selected for knitting. The selecting mechanism 9, which is illustrated in greater detail in FIG. 4, comprises, for each preselected yarn, a positioning lever 11 whose end carries an eyelet 12 for the passage of the yarn. Each positioning lever 11 is hinged to two arms 13 and 14, which are in turn hinged as seen in FIG. 4 about two fixed axes 13*a* and 14*b*. The arm 14 is actuated by a circular cam 15 with three diameters, determining three positions of the positioning lever 11, i.e. selecting positions, working positions and non-selecting positions. This circular cam 15 also actuates a second lever 16, the end of which is in engagement with a yarn gripping slide 17 which, in cooperation with a knife 17*a*, cuts the yarn. Each of these levers 11 and 16 is resiliently pressed against the circular cam by a spring 18 or 19. This circular cam 15 is rigid with a concentric toothed wheel 20 adapted to rotate the circular cam 15 under the control of an actuating mechanism comprising a selecting arm 21 which is subject to the action of a selecting button 23 controlled by the programming device (not shown) of the frame. This selecting arm 21 is hinged to the end of a lever 24 (FIGS. 2 and 3), which is in turn hinged to the framework B of the apparatus and carries all the selecting arms. This lever 24 also carries a roller 25 adapted to engage with two ramps 26 and 27 which are rigid with the rods of two respective jacks 28 and 29.

The joining mechanism 10 (FIG. 2) associated with the selecting mechanism which has just been described comprises an eccentric finger 30 associated with a drive motor 31. This finger 30 comprises a passage 30*a* of constant cross section which is radially directed with respect to the axis of rotation and is defined by radial planes. The stop position of this finger 30 is selected such that its passage 30*a* is disposed substantially parallel to the yarn $f_1$ being knitted with its radial bounding planes on opposite sides of the yarn. An angled lever 32 is hinged in the radial plane of the passage 30*a* in the stop position. Another elbow lever 33 is hinged in a plane perpendicular to the lever 32 and to the radial planes bounding the passage 30*a* and the path of its angled end passes between the yarn $f_1$ being knitted and the finger 30. This lever 33 is subject to the action of a return spring 34 which presses an inclined edge 33*a* of this lever 33 against the lever 32, such that the movement of the lever 33 under the action of the return spring 34 is a direct and predetermined function of the position of the lever 32. A hooking lever 35 is also hinged to the lever 32 about an axis which is perpendicular to that of this lever and pivots in a plane perpendicular to the aforesaid radial planes. A cam formed by a hemispherical head 36 rigid with the framework B is disposed in the path which this lever 35 describes during the movement of the lever 32, so as to make this lever 35 rock in order to hook the yarn selected for knitting, as will be explained in the following. This assembly of levers 32, 33 and 34 is actuated by a jack 37. Finally, a fixed arm 54 is disposed so as to position the yarn $f_2$ selected for knitting on the finger 30, as will be explained in the following.

During normal operation, that is knitting with the yarn $f_1$ as indicated at time $t_0$ in FIGS. 6*a* through 6*h*, the lever 11 of the yarn $f_2$ (and indeed of yarns $f_3$ and $f_4$) is in position 0 of FIG. 6*a* with the yarn $f_2$ held out of the path of the rotary finger 30. Meanwhile the slide clamp 17 of this yarn $f_2$ is as shown in FIG. 6*b* in its closed or gripping position in which it tightly holds the yarn end. The knotting finger is stationary and pointing generally in the displacement direction of the yarn $f_1$, which is illustrated at position 0 in FIG. 6*c*, and the looping lever 32 is retracted, the clip 35 down, and the lever 33 down as shown at positions 0 in FIGS. 6*d*, 6*e*, and 6*f*, respectively. The lever 11 of the yarn $f_1$ being knitted is meanwhile in its working position 1 as shown in FIG. 6*g* to feed this yarn $f_1$ past its clip 17 and out the hole 3, and the clip 17 of the yarn f1 is in the open position as shown at 1 in FIG. 6*h*. In this position the selecting arm 21 of the yarn $f_1$ being knitted is pressed against the force of its spring 22 against its cam 20 but the other selecting arms 21 are out of engagement with their cams 20.

The button 23 for the next yarn $f_2$ to be knitted is actuated to hold the respective arm 21 against its cam 20 and the actuator or jack 28 pushes up the arms 21 through half a step, thereby rotationally indexing the cams 20 of the yarns $f_1$ and $f_2$ through half a step, here 30°. This action takes place between time $t_0$ and $t_1$ and serves to move the lever 11 as shown in FIG. 6*a* from the inoperative position 0 to the select position 2 in which it lifts the yarn f2 into a position where it is in the rotary path of the finger 30 as shown in FIGS. 5*a* through 5*d* also. The other parts of the mechanism do not move between times $t_0$ and $t_1$.

Figure 5C:
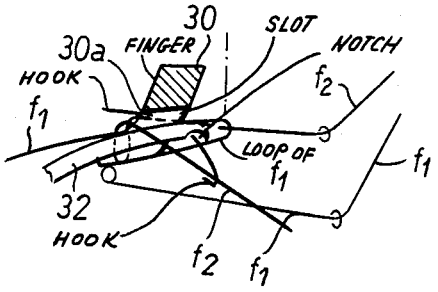

Then at time $t_1$ the motor 31 starts rotating the finger 30 twice about its axis, moving the finger 30 from the position of FIG. 5*a* at time $t_1$ to the position of FIG. 5*b* and eventually leaves it in the position of FIG. 5*c*. This double rotation first forms a single closed loop of the yarn $f_2$ on the finger 30 and catches it on the bent arm 54, and then forms a second closed loop and pulls the yarn $f_2$ off this arm. 54.

At time $t_2$ the finger 30 is stopped and the jack or actuator 37 starts raising the lever 32 as shown in FIG. 6*d*. As this lever 32 moves from the fully lowered position 0 to the fully raised position it engages the filament f1 being knitted and pushes it as an open loop into the closed loops on the finger 30 as shown in FIG. 5*d*. During the ascent of this lever 32, however, first of all the lever 33 rocks up starting at time $t_3$ to engage its pin 33*b* behind the filament f1 to keep the open loop of the yarn f1 running smoothly and when the lever 32 is all the way up at time $t_4$ the lever 35 rocks to push its hook through the notch 32*a* of the lever 32 and through the open loop of the yarn $f_1$ and behind the closed loops of the yarn $f_2$, with the hook of the lever 35 catching on the yarn f2 between its closed loops and the end in its clip 17. This corresponds to the position of FIG. 3 and instant $t_5$.

Starting at time $t_5$ (see FIG. 5*c*) the actuator 29 pushes the ramp 27 under the roller 25 and lifts the arms 21 another half step to move the lever 11 of the yarn $f_2$ into work position 1 and the lever 11 of the yarn $f_1$ into the inoperative position 0. Simultaneously the piston of the actuator 37 is retracted which causes the hook formed at the end of the lever 35 to move back under the force of a return spring (not shown) wound around its axis and pick up the yarn $f_2$, pulling it through the open loop of the yarn f1 as illustrated in FIG. 6*e*, thereby tensioning the yarn $f_2$ and tightening the loop. Such retraction of the lever 35 is accompanied by forward movement of the lever 32 and of the hooked end of the filament f2, pulling as shown in FIG. 5*e* the loops of the yarns f1 and f2 off the finger 30 and tightening them together as a knot. The clip 17 of the yarn f2 simultaneously moves from the closed to the open position as shown in FIG. 6*b* to release the end of the yarn f2.

Finally as shown in FIG. 5*f* at time $t_6$ the knife 17 of the filament $f_1$ moves to cut the yarn f1, allowing the knot formed as described above to move off to the knitting machine. The cutting of the yarn $f_1$ immediately follows the release of the yarn $f_2$ (FIG. 6*c*) and the knotting of the yarns $f_1$ and $f_2$ together. Last of all, starting at time $t_7$, the lever 33 drops out of the way.

Figure 7:
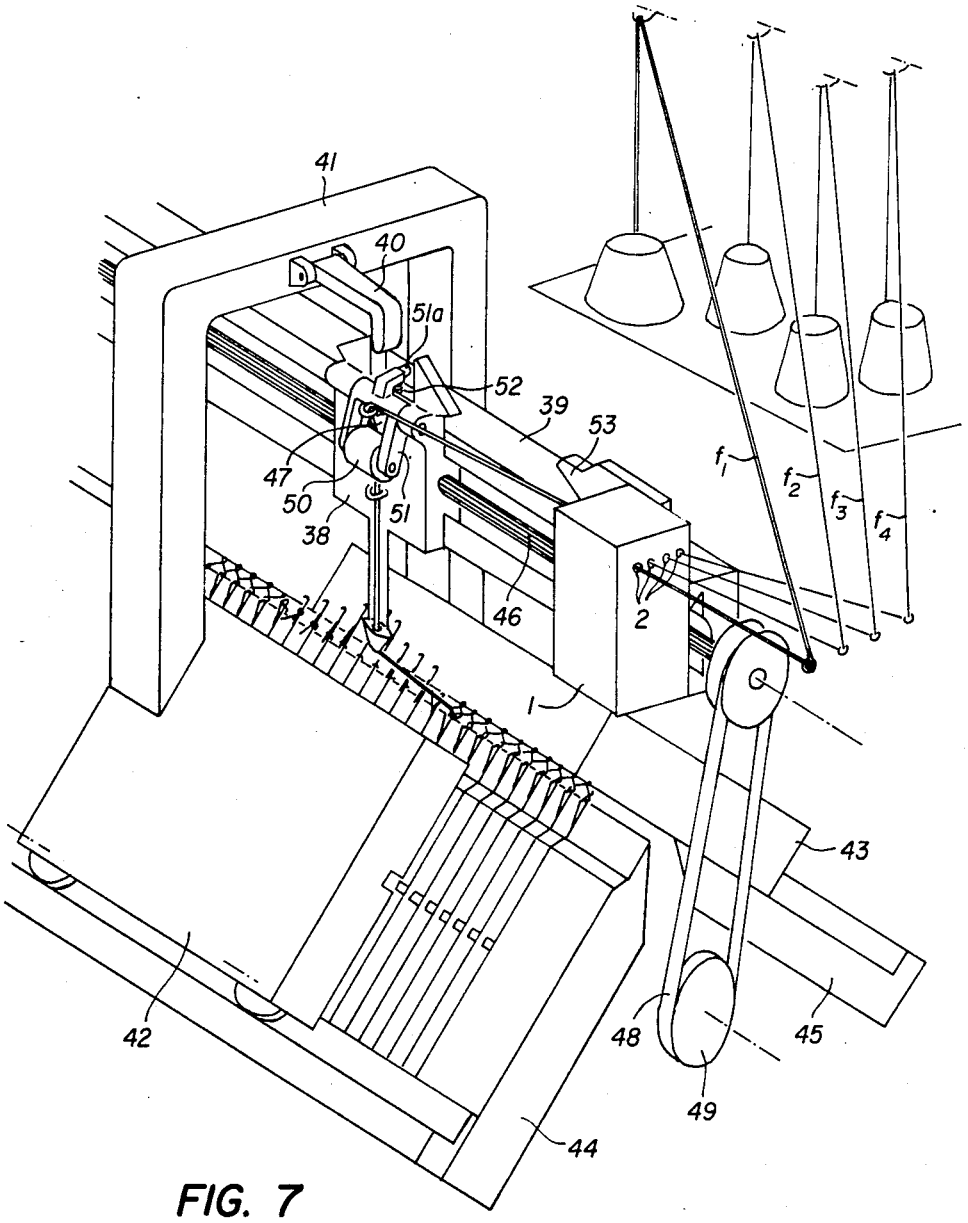
FIG. 7 is a perspective view of the second embodiment of the invention, relating to a rectilinear frame.

It should be noted that this joining knot between the knitted yarn $f_1$ and the yarn $f_2$ to be knitted is formed without stoppage or storage of the yarn while the latter is being knitted. In fact the open loop of the selected yarn $f_1$ being knitted, which is formed by means of levers 32 and 33 through the closed loop of the yarn $f_2$ selected for knitting, permits the supply of the yarn $f_1$ to be continued so long as the joining knot is not tightened. Once this knot has been tightened, it is the yarn $f_2$ which is entrained after it. This solution is therefore extremely simple, as it only requires one joining device associated with each selecting station, thus reducing the height of the knitting frame. As only the selected yarn being knitted leaves the knitting station and the end of this yarn and the beginning of the yarn selected for knitting are attached to one another, the selecting station may be remote from the beds of the machine, e.g. in a circle of greater diameter than the bed, which at the same time permits the yarn being knitted to be passed through a feed mechanism which moves the yarn towards the needles at a determined tension. The second embodiment illustrated in FIG. 7 shows the selecting station 1 illustrated in detail by FIGS. 2 to 6 mounted on a flat-bed knitting frame.

This figure shows the four preselected yarns $f_1$, $f_2$, $f_3$ and $f_4$ entering the selecting station and the selected yarn, for example the yarn $f_1$, which emerges therefrom and moves towards a yarn guide 38 slidably mounted on a yarn guide bar 39 in engagement with a drive finger 40 of a yoke 41 which connects two carriages 42, 43 of a rectilinear frame having two beds 44, 45. This yarn guide 38 is associated with a supply mechanism comprising a splined shaft 46 on which a roller 47 is slidably keyed. This splined shaft 46 is driven by a belt 48 in engagement with a drive pulley 49. A second roller 50, which is mounted on a rocking support 51, is resiliently pressed by a spring 52 against the roller 47, while gripping the yarn $f_1$, which is thus entrained. Cams 53 are disposed at the ends of the path of travel of the yarn guide 38 and serve to disengage the roller 50 from the roller 47, while rocking the support 51, one finger 51*a* of which engages with these cams. It is of course possible to provide a selecting station of this type for each knitting system; it is thus possible, with one rectilinear frame having two beds and two knitting systems per bed, to dispose two selecting stations, at each end, on either side of the yarn guide bar 39. Similarly, it is possible to provide a plurality of yarn guide bars 39.

We claim:

1. A method of joining a yarn selected for knitting to a yarn being knitted, the method comprising the steps of sequentially while the yarn being knitted moves continuously in a travel direction along a path holding the end of the yarn selected for knitting adjacent the path of the yarn being knitted, forming a closed loop of the selected yarn in the vicinity of the held end on a finger projecting in the direction of travel of the yarn being knitted, deflecting the yarn being knitted adjacent and spaced from the held end so as to give the deflected yarn portion the form of an open loop, passing this open loop through the closed loop on the finger, gripping the yarn selected for knitting between the open loop and the held end and passing the gripped portion through this open loop, thereafter generally simultaneously tightening the closed loop by applying tension to the gripped portion of the yarn selected for knitting to form a knot by pulling the gripped portion in the direction of movement of the yarn being knitted and thereby pulling both loops off the finger, and cutting the yarn being knitted upstream of the knot relative to the yarn travel direction, and releasing the held end so that the knotted yarns move off in the travel direction.

2. In a knitting frame comprising knitting needles and a yarn selecting device having at least two inlets each of which receives a respective preselected yarn, an outlet for a yarn selected by this device, a yarn guide for bringing this selected yarn from the outlet to the knitting needles of the knitting frame, and a joining mechanism associated with the yarn guide for joining a yarn being knitted to the yarn selected for knitting, the improvement wherein the joining mechanism comprises: means for forming a closed loop from the yarn selecting for knitting, said means comprising a finger mounted for movement eccentrically about an axis of rotation in a path intersecting that of the yarn selected for knitting, and a drive member for the finger having a predetermined stop position, the finger having a passage with a constant cross-section passing radially through the finger with respect to its axis of rotation, the passage being defined by radial planes which, when the finger is in the stop position, lie on opposite sides of the path of the selected yarn being knitted;

means for forming an open loop from the yarn being knitted and for passing this loop through the closed loop, said means for forming comprising a first lever movable in a path which passes between the radial planes defining the passage and intersects that of the selected yarn being knitted, and a second lever hinged in a plane perpendicular to the radial planes of the passage in the stop position of the finger and having an angled end with a path of moving which passes between the selected yarn being knitted and the eccentric finger;

means for passing through the open loop the portion of the yarn selected for knitting which is comprised between its end and the closed loop and for releasing the closed loop from the means which formed it and for tightening it while pulling the end in the direction of the yarn being knitted, said means for passing the portion of yarn through the open loop comprising a hooking lever hinged in a plane perpendicular to the radial planes of the passage;

means for cutting the yarn being knitted behind the knot; and means for successively driving the finger and the three levers in synchronism.

3. A knitting frame according to claim 2, in which said hooking lever of said means for passing through the said open loop the said portion of yarn selected for knitting is hinged to said first lever.

4. An apparatus for joining a yarn selected for knitting to a yarn being knitted, the apparatus comprising:

a housing having a plurality of inlets each adapted to receive a respective incoming yarn and an outlet;

means for continuously pulling a yarn being knitted from the outlet of the housing;

gripper means for holding the end of the yarn selected for knitting and for releasing the end of the yarn selected for knitting;

looping means including a rotary finger for forming a closed loop of the selected yarn in the vicinity of the held end; and guide and tying means for deflecting the yarn being knitted adjacent and spaced from the held end so as to give the deflected yarn portion the form of an open loop and for passing this open loop through the closed loop on the finger, the guide and tying means including a hook for gripping the yarn selected for knitting between the open loop and the held end and passing the gripped portion through this open loop, and for thereafter generally simultaneously tightening the closed loop by applying tension to the gripped portion of the yarn selected for knitting to form a knot by pulling the gripped portion by the hook in the direction of movement of the yarn being knitted and thereby pulling both loops off the finger, and cutting the yarn being knitted upstream of the knot relative to the yarn travel direction, the gripper means releasing the held end so that the knotted yarns move off in the travel direction.

* * * * *